US006873221B2

(12) United States Patent
Lucero et al.

(10) Patent No.: US 6,873,221 B2
(45) Date of Patent: Mar. 29, 2005

(54) MULTILAYER BALUN WITH HIGH PROCESS TOLERANCE

(75) Inventors: Rodolfo Lucero, Scottsdale, AZ (US); Anthony M. Pavio, Paradise Valley, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/428,175

(22) Filed: Apr. 30, 2003

(65) Prior Publication Data

US 2004/0217824 A1 Nov. 4, 2004

(51) Int. Cl.[7] ..... H01P 5/10
(52) U.S. Cl. ..... 333/26; 336/200
(58) Field of Search ..... 333/26, 116, 246, 333/84 M; 336/200, 232, 223

(56) References Cited

U.S. PATENT DOCUMENTS 3,846,721 A * 11/1974 Fritz et al. ..... 333/26
5,497,137 A * 3/1996 Fujiki ..... 336/200
5,886,589 A * 3/1999 Mourant ..... 333/26
6,388,551 B2 * 5/2002 Morikawa ..... 336/223

* cited by examiner

*Primary Examiner*—Dinh T. Le

(57) ABSTRACT

An exemplary system and method for minimizing degradation effects attributed to misalignment in the production of multilayer balun devices is disclosed as comprising inter alia any combination of coupled line folding that effectively provides a degenerate or otherwise reducible representation of line segment components wherein at least about half of the line segments (by, for example, linear distance or by line volume) are substantially orthogonal to the remaining half.

10 Claims, 3 Drawing Sheets

MULTILAYER BALUN WITH HIGH PROCESS TOLERANCE

FIELD OF INVENTION

The present invention generally concerns balun devices; and more particularly, in various representative and exemplary embodiments, to multilayer balun devices suitably adapted for minimizing or otherwise optimizing the effects of registration error during fabrication.

BACKGROUND

Baluns are used extensively in modern wireless applications requiring differential signal inputs; however, baluns employing broadside-coupled lines generally suffer phase and amplitude imbalance degradation in manufacture due inter alia to misalignment between coupled line structures. An example of such a conventional capacitively-loaded balun realized in LTCC has been described, for example, in "A Design of the Ceramic Chip Balun Using the Multilayer Configuration", Lew et al., *IEEE Transactions on MTT*, January 2001, wherein the common-mode rejection ratio (CMRR) of the balun disclosed therein is generally subject to significant degradation in production due, for example, to misalignment of the coupled line sections.

Any multilayer production process typically demonstrates alignment tolerances. To the extent that state of the art tolerances for LTCC layer-to-layer alignment currently are on the order of about 20 $\mu$m, with printed circuit board alignment tolerances as high as about 75 $\mu$m, there exists a need for a system and method to minimize degradation effects attributed to misalignment in the production of multilayer balun devices.

SUMMARY OF THE INVENTION

In various representative aspects, the present invention provides a system and method for minimizing degradation effects attributed to misalignment in the production of multilayer balun devices. An exemplary system and method for providing such a device is disclosed as comprising inter alia any combination of coupled line folding that effectively provides a degenerate or otherwise reducible representation of line segment components wherein at least half of the line segments (by, for example, linear distance and/or volume) are substantially orthogonal to the remaining half. Fabrication is relatively simple and straightforward. Additional advantages of the present invention will be set forth in the Detailed Description which follows and may be obvious from the Detailed Description or may be learned by practice of exemplary embodiments of the invention. Still other advantages of the invention may be realized by means of any of the instrumentalities, methods or combinations particularly pointed out in the claims.

BRIEF DESCRIPTION OF THE DRAWING

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent to skilled artisans in light of certain exemplary embodiments recited in the Detailed Description, wherein:

Figure 1:
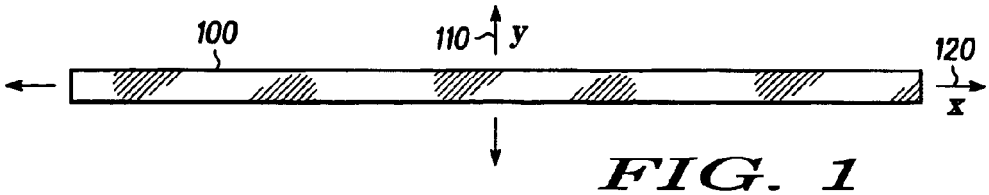
FIG. 1 representatively depicts a top view of a broadside-coupled line in accordance with an exemplary embodiment of the present invention.

Those skilled in the art will appreciate that elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms 'first', 'second', and the like herein, if any, are used inter alia for distinguishing between similar elements and not necessarily for describing a sequential or chronological order. Moreover, the terms front, back, top, bottom, over, under, and the like in the Description and/or in the claims, if any, are generally employed for descriptive purposes and not necessarily for comprehensively describing exclusive relative position. Skilled artisans will therefore understand that any of the preceding terms so used may be interchanged under appropriate circumstances such that various embodiments of the invention described herein, for example, are capable of operation in other geometries, configurations and/or orientations than those explicitly illustrated or otherwise described.

DETAILED DESCRIPTION OF EXEMPLARY EMBODIMENTS

The following descriptions are of exemplary embodiments of the invention and the inventors' conceptions of the best mode and are not intended to limit the scope, applicability or configuration of the invention in any way. Rather, the following Description is intended to provide convenient illustrations for implementing various embodiments of the invention. As will become apparent, changes may be made in the function and/or arrangement of any of the elements described in the disclosed exemplary embodiments without departing from the spirit and scope of the invention.

A detailed description of an exemplary application, namely a system and method for ameliorating degradation effects associated with layer-to-layer alignment in the production of, for example, LTCC balun devices is provided as a specific enabling disclosure that may be readily generalized by skilled artisans to any application of the disclosed system and method for minimizing registration in multilayer processes in accordance with various other embodiments of the present invention.

In the case of a capacitively compensated balun, the lengths of the coupled line segments may be reduced at the expense of bandwidth. Such a tradeoff, for example, may be used to realize a balun having a compact form factor for operation in the up to about 1E6 Hz to more than about 1E9 Hz range (perhaps preferably, on the order of about 800–1000 MHz). In practice, an input RF signal is supplied to the balun which in turn generates a plurality of phase-shifter RF outputs. In one application, two such RF outputs may ideally comprises the same amplitude shifted in phase by 180 degrees. Any deviation from the ideal case, however, results in phase and/or amplitude imbalance which generally operates to degrade the performance of the balun. One method for characterizing such imbalance involves the determination of the common-mode rejection ration (CMRR), which generally provides a substantially unitary metric of balun performance.

In one representative aspect, in accordance with various exemplary embodiment of the present invention, a system and method is disclosed for minimizing the effects of multilayer registration error on the performance of, for example, an integrated balun. In general, such registration error typically leads inter alia to the degradation of the CMRR performance of the balun. Such registration error may comprise, for example, misalignment between the layers of a multilayer stack and/or print deviations or other variations in certain line features.

Registration error may be particularly of interest when the coupled lines used to define a balun circuit are defined, for example, on different layers. Misalignment between these layers may change the coupling characteristics between the lines, thereby adversely affecting balun performance.

As representatively depicted, for example, in FIG. 1, a straight coupled-line segment 100 whose misalignment along the x-coordinate 120 would generally operate to dispose differential components of line segment 100 in positions previously occupied by other differential line components. Accordingly, absent other considerations, net differential displacement along the x-coordinate 120 generally would not be expected to substantially degrade performance of a balun employing the coupled-line segment 100 illustrated in FIG. 1. This would not be the case, however, for differential displacement along the y-coordinate 110.

As line segment 100 is nominally misaligned along the y-coordinate 110, differential components of line segment 100 are disposed in positions previously not occupied by other differential line components. Accordingly, net differential displacement along the y-coordinate 110 generally would be expected to effectively degrade performance of a balun employing the coupled-line segment 100 illustrated in FIG. 1.

Figure 2:
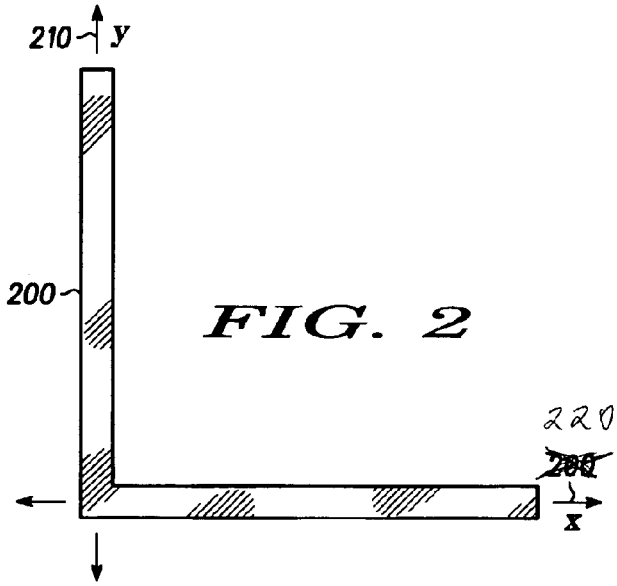
FIG. 2 representatively illustrates a top view of a broadside-coupled line folded into an "L-shape" in accordance with another exemplary embodiment of the present invention.

In accordance with one representative and exemplary embodiment of the present invention, FIG. 2 generally depicts a broadside-coupled line segment 200 generally configured to minimize registration error. As representatively illustrated, an "L-shaped" coupled-line segment 200 misaligned along the x-coordinate 220 would generally operate to differentially dispose only one half of the line components of segment 200 to positions previously occupied by other differential line components (e.g., those line segment components originally disposed along the x-coordinate 220). As line segment 200 becomes nominally misaligned along the y-coordinate 110, the remaining half of differential components of line segment 100 (e.g., those line segment components originally disposed along the y-coordinate 210) would be disposed to positions previously occupied by the remaining half of line components. Accordingly, the total differential displacement along the x-coordinate 220 and y-coordinate 210 generally would be expected to substantially minimize or otherwise reduce the degradation of performance experienced by a balun employing the coupled-line segment 200 illustrated in FIG. 2 where the vector direction of misalignment may not be effectively predetermined.

Figure 3:
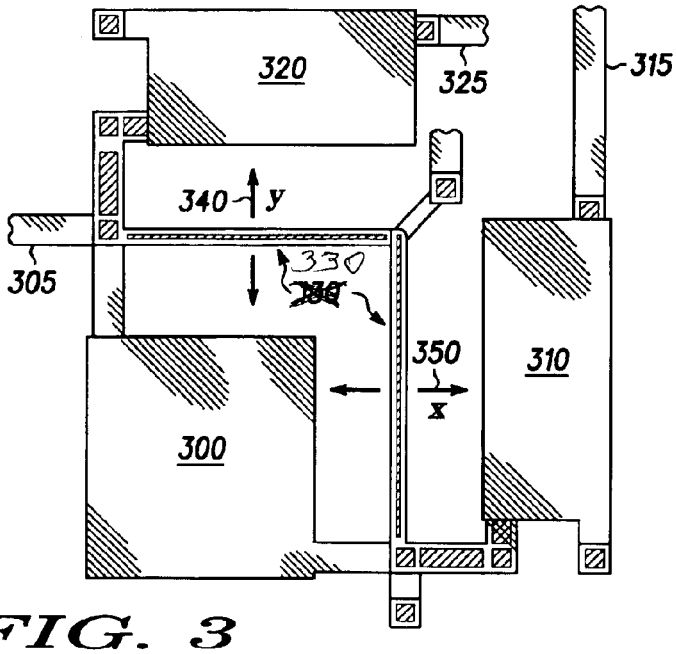
FIG. 3 representatively depicts a top view of a multilayer balun device employing the "L-shaped" broadside-coupled line according to FIG. 2.

As generally depicted, for example, in FIG. 3, a multilayer balun configured to minimize the effects of registration error and/or other process variations, such as, for example, dielectric layer compression, is illustrated as comprising inter alia: a plurality of load capacitors 310, 320; a compensation capacitor 300; an RF input 305; a plurality of RF outputs 315, 325; and an "L-shaped" broadside-coupled line 330. In such a configuration, the capacitors are generally configured to shunt parasitic capacitance created between, for example, the outer plates of the multilayer capacitor structure to ground, thereby removing or otherwise ameliorating the influence of this parasitic capacitance on the performance of the balun device. Additionally, load capacitors 320, 310 may be realized by using multiple layers so that misalignment of one layer generally operates to minimize or otherwise optimize the change in total capacitance for the device.

Unique to the balun device, in accordance with one exemplary and representative aspect of the present invention, is the use of the "L-shaped" coupled-line section 330, wherein misalignment, along either the x-coordinate 350 or the y-coordinate 340, of those layers which generally define the broadside coupled lines generally only affects half of the total differential line components as described vide supra. Accordingly, the line configuration depicted in FIG. 3 generally operates to minimize or otherwise ameliorate the perturbation in the broadside line's RF coupling characteristics—notably, since the direction(s) of misalignment during the multilayer fabrication process are generally not predictable. Moreover, the "L-shaped" balun generally depicted in FIG. 3 may be understood as comprising one embodiment of the present invention more suitably adapted for maintaining the generally required even and odd mode impedance in a typical manufacturing environment.

Figure 4:
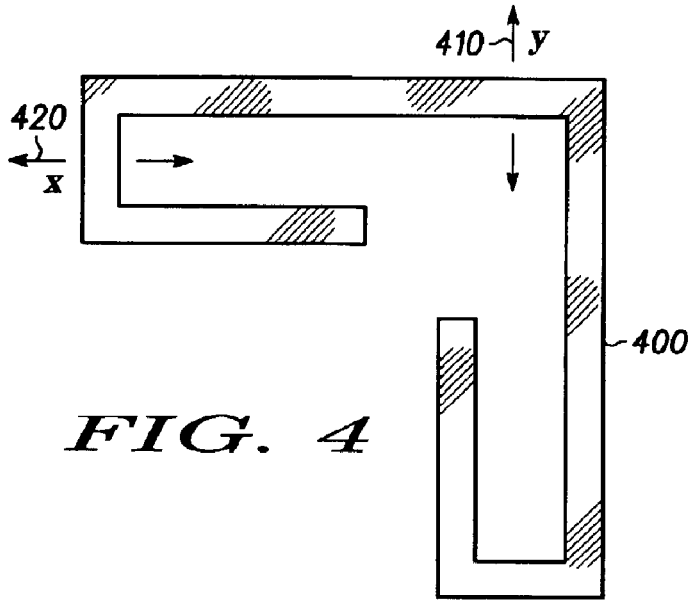
FIG. 4 representatively illustrates a top view of another broadside-coupled line geometry wherein the line has been folded into a degenerate "L-shaped" configuration in accordance with another exemplary embodiment of the present invention.
Figure 5:
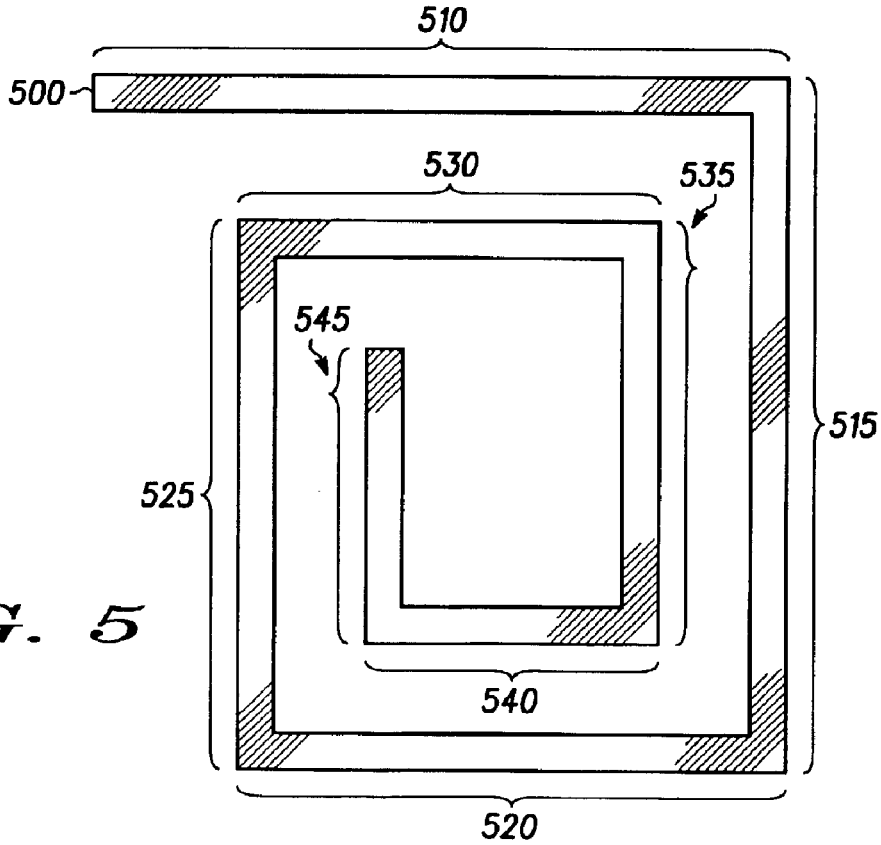
FIG. 5 representatively illustrates a top view of another broadside-coupled line geometry wherein the line has been folded into a degenerate orthogonal configuration in accordance with yet another exemplary embodiment of the present invention.

Skilled artisans will appreciate, however, that the present invention need not be limited to a unitary "L-shaped" structure or device component feature. Structures generally consistent with those representatively illustrated, for example, in FIG. 4 and FIG. 5 may also be effectively employed to produce a substantially similar result in accordance with various other embodiments of the present invention. For example, in FIG. 4, any misalignment along either the x-coordinate 420 or the y-coordinate 410 would only be expected to affect one half of the segments of line component 400, respectively. As generally illustrated, for example, in FIG. 5, an alternative geometry providing xy pairs, wherein one half of the components 510, 520, 530, 540 of line feature 500 are matched with the remaining half of line segment components 515, 525, 535, 545, is also representatively disclosed. Accordingly, skilled artisans will appreciate that with respect any at least partially conductive line feature integrated in a multilayer manufacturing process, any combination of line folding capable of producing a degenerate or otherwise reducible representation of line segment components, wherein approximately one half of the line segments are substantially orthogonal to the remaining half of line segments, may be alternatively, conjunctively and/or sequentially employed in accordance with various other embodiments and representative aspects of the present invention.

Figure 6:
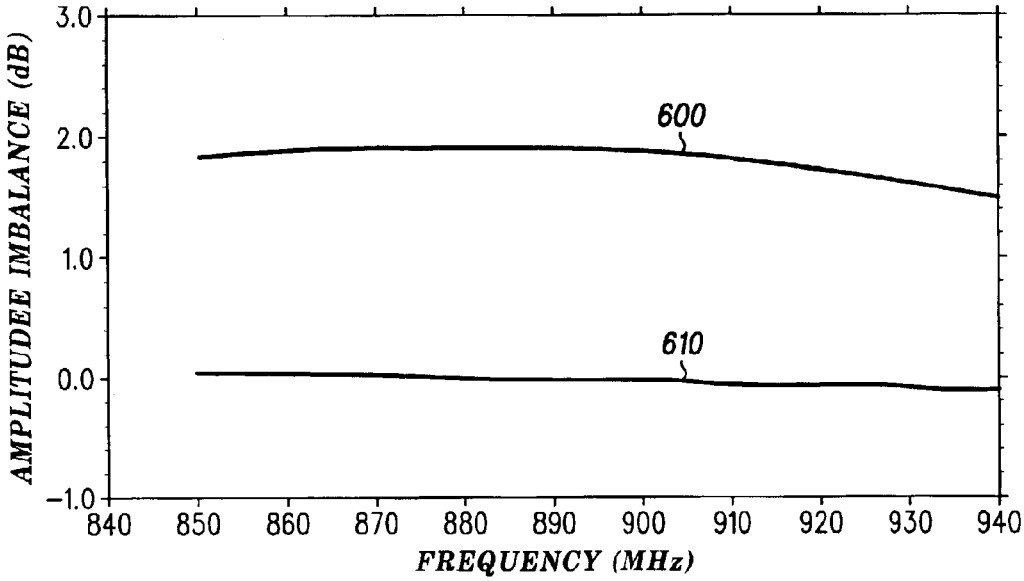
FIG. 6 representatively depicts amplitude imbalance profiles for the broadside-coupled lines generally illustrated, for example, in FIG. 1 and FIG. 2.
Figure 7:
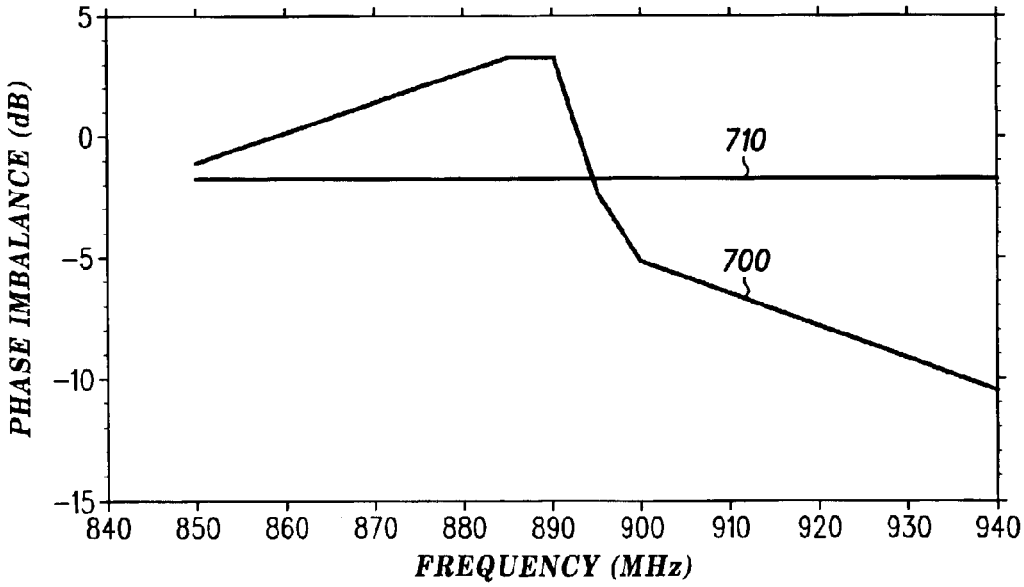
FIG. 7 representatively depicts phase imbalance profiles for the broadside coupled lines generally illustrated, for example, in FIG. 1 and FIG. 2.

Both computer simulation and laboratory measurements obtained for prototype baluns have demonstrated misalignment of the broadside-coupled lines 330 as comprising minimal effect on the CMRR performance of the balun representatively depicted, for example, in FIG. 3. Additional computer simulations were performed for the balun illustrated in FIG. 3 for a simultaneous 2-mil registration error along both the x-coordinate 350 and the y-coordinate 340. Such an error would not typically be expected to be observed in LTCC fabrication, however, such an error would be analogous to a balun designed with a broadside-coupled line comprising a substantially unitary straight section. FIG. 6 and FIG. 7 representatively illustrate the amplitude and phase imbalance, respectively, for baluns designed with a single straight section 600, 700 and in accordance with an "L-shaped" embodiment in accordance with the present invention 610, 710. The corresponding CMRR performance was observed to be less than 3 dB total, of which less than 0.5 dB may be attributed to amplitude imbalance with the remainder corresponding to phase imbalance.

In the foregoing specification, the invention has been described with reference to specific exemplary embodiments; however, it will be appreciated that various modifications and changes may be made without departing from the scope of the present invention as set forth in the claims below. The specification and figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above. For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components of any or all the claims.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted by those skilled in the art to specific environments, manufacturing specifications, design parameters or other operating requirements without departing from the general principles of the same.

We claim:

1. A balun circuit comprising:

a balun comprising:

a first line; and a second line aligned with and positioned near the first line, both the first and second lines having a first portion positioned in a first direction and a second portion positioned in a second direction orthogonal to the first direction, wherein both the first and second portions have first and second ends, the second ends of each portion being connected;

an RF input coupled to the first end of the first portions;

first and second RF outputs;

a first load capacitor coupled between the first RF output and the first end of the first portions;

a second load capacitor coupled between the second RF output and the first end of the second portion; and a compensation capacitor coupled between the first ends of the first and second portions.

2. The balun of claim 1 wherein the length of the first and second portions are determined by considering the distance between the first and second lines.

3. The balun of claim 1 wherein the lengths of the first and second portion of each line are substantially equal.

4. The balun of claim 1 further comprising additional portions for both of the first and second lines, to form substantially an "L-shaped" structure.

5. The balun of claim 1 further comprising additional portions for both of the first and second lines, to form substantially a "spiral-shaped" line structure.

6. A balun system, comprising:

a balun comprising:

at least two lines;

a first portion of the at least two lines positioned in a first direction; and a second portion of the at least two lines positioned in a second direction orthogonal to the first direction, wherein the balun has first and second ends;

an RF input coupled to the first end;

first and second RF outputs;

a first load capacitor coupled between the first RF output and the first end;

a second load capacitor coupled between the second RF output and the second end; and a compensation capacitor coupled between the first and second end.

7. The balun of claim 6 wherein the length of the first and second portions are determined by considering distances between the at least two lines.

8. The balun of claim 6 wherein the lengths of the first and second portions are substantially equal.

9. The balun of claim 6 further comprising additional portions for the at least two lines, to form substantially an "L-shaped" structure.

10. The balun of claim 6 further comprising additional portions for the at least two lines, to form substantially a "spiral-shaped" line structure.

* * * * *